US007372363B2

(12) United States Patent
Durbin

(10) Patent No.: US 7,372,363 B2
(45) Date of Patent: May 13, 2008

(54) SECURITY DEVICE FOR A BOTTLE

(75) Inventor: Paul Francis Durbin, Hertford (GB)

(73) Assignee: Plescon Limited, Suffolk (GB)

( * ) Notice: Subject to any disclaimer, the term of this patent is extended or adjusted under 35 U.S.C. 154(b) by 384 days.

(21) Appl. No.: 11/031,050

(22) Filed: Jan. 7, 2005

(65) Prior Publication Data

US 2005/0151381 A1 Jul. 14, 2005

(30) Foreign Application Priority Data

Jan. 8, 2004 (GB) ..... 0400280.4

(51) Int. Cl.
*G08B 13/14* (2006.01)

(52) U.S. Cl. ..... 340/568.1; 215/207; 215/201; 340/540

(58) Field of Classification Search ..... 215/201, 215/207; 340/568.1, 540
See application file for complete search history.

(56) References Cited

U.S. PATENT DOCUMENTS

| | | | | |
|---|---|---|---|---|
| 3,295,730 A | | 1/1967 | Moran | |
| 3,790,197 A | * | 2/1974 | Parker | 292/251.5 |
| 3,930,388 A | * | 1/1976 | Barras | 70/159 |
| 4,176,756 A | * | 12/1979 | Gellman | 215/274 |
| 4,377,245 A | * | 3/1983 | Patty | 220/822 |
| 4,457,445 A | * | 7/1984 | Hanks et al. | 220/214 |
| 5,385,373 A | * | 1/1995 | Love | 292/307 B |
| 5,409,125 A | | 4/1995 | Kimber et al. | |
| 5,464,109 A | * | 11/1995 | Greenwald | 215/207 |
| 5,602,530 A | | 2/1997 | Holmgren | |
| 5,817,082 A | | 10/1998 | Niedospial et al. | |
| 5,873,144 A | * | 2/1999 | Tupper et al. | 16/18 CG |
| 5,902,298 A | | 5/1999 | Niedospial et al. | |
| 5,908,124 A | | 6/1999 | Klauke et al. | |
| 5,957,313 A | | 9/1999 | Bouan | |
| 6,029,322 A | | 2/2000 | Belotti et al. | |

(Continued)

FOREIGN PATENT DOCUMENTS

EP 0 915 222 12/1999

(Continued)

OTHER PUBLICATIONS

U.S. Appl. No. 29/214,885, filed Oct. 8, 2004, Durbin.

*Primary Examiner*—Anthony Stashick
*Assistant Examiner*—Christopher McKinley
(74) *Attorney, Agent, or Firm*—Shupe & Munger Ltd.

(57) ABSTRACT

A security device for tagging a bottle has a body defining a sleeve into which part of the bottle neck and its closure are received. A housing is defined to one side of the sleeve and first and second catch members are pivoted within the housing for movement between free and locking positions. When in their locking positions, the catch members project into the sleeve to engage behind a shoulder on the bottle neck or the closure, to resist removal of the device. An operating member is also pivoted to the housing for movement between open and closed positions, springs being arranged between the operating member and the first and second catch members to urge the catch members to their respective locking positions. A magnetically-releasable latch is arranged to hold the operating member in its closed position unless the latch member is acted upon by an external magnetic field.

19 Claims, 4 Drawing Sheets

U.S. PATENT DOCUMENTS

| | | | | |
|---|---|---|---|---|
| D426,870 | S | 6/2000 | Selepouchin | |
| 6,098,256 | A * | 8/2000 | Poussard | 24/704.1 |
| 6,173,852 | B1 | 1/2001 | Browne | |
| 6,205,629 | B1 * | 3/2001 | Becker | 24/633 |
| 6,604,643 | B1 * | 8/2003 | Michael et al. | 215/204 |
| 6,626,308 | B2 | 9/2003 | Weiler | |
| 6,769,557 | B2 * | 8/2004 | Michael et al. | 215/204 |
| D498,408 | S | 11/2004 | Haas | |
| 6,822,567 | B2 * | 11/2004 | Durbin | 340/568.1 |
| 7,007,523 | B2 | 3/2006 | Belden, Jr. | |

FOREIGN PATENT DOCUMENTS

| | | |
|---|---|---|
| FR | 2 704 592 | 4/1993 |
| WO | WO01/75254 | 10/2001 |
| WO | WO03/046319 | 6/2003 |

* cited by examiner

SECURITY DEVICE FOR A BOTTLE

CROSS REFERENCE TO RELATED APPLICATIONS

This invention claims the priority of UK Patent Application No. 04 00280.4 filed in the name of Plescon Limited on Jan. 8, 2004, the contents of which are incorporated herein.

BACKGROUND OF THE INVENTION a) Field of the Invention

This invention relates to a security device for a bottle—that is to say, a device which may be secured to a bottle and which may serve to reduce the likelihood of misappropriation of the bottle, for example from a shop or store.

b) Description of the Prior Art

Theft of various products from shops is an ever increasing problem, especially with self-selection stores. In an attempt to address this problem, it is now a common practice to attach a security label to the products on offer, even for products not having an especially high value, which security label is adapted and configured to trigger an alarm mechanism should the product carrying the label be taken out of the store before the label has been disabled in some way, or otherwise removed from the product.

With many products, label-based security systems work well but an important aspect of security systems of this kind is that the system should be highly visible, so as to act as a deterrent against theft. On the other hand, the label should not damage the product, or otherwise make the product less attractive to a purchaser. In view of this, some security systems utilise a device which is intended only for temporary attachment to a product so long as the product remains in the shop—for example, in the case of clothing. At the time of purchase of the product, the security device is removed from the product so that the product may be carried out of the store without evidence of the previous presence of the security device attached to the product. A particular problem arises in the case of high-value bottles of drink, such as spirits, champagnes and vintage wines. The only way in which a label can be attached to a glass bottle is by means of an adhesive, but the use of such a label detracts from the aesthetic qualities of the product. Moreover, if the label has sufficiently strong adhesive to prevent it being removed in an unauthorised way by an intending thief, a purchaser cannot subsequently easily remove the label, for example if the product is purchased as a gift for a third party.

In WO 01/75254 (Plescon Limited) we have described and claimed a security device which is intended to be fitted to the neck of a bottle and which can be released only by subjecting the device to an appropriate external magnetic field. The device may be provided with a security label to which a store security system will respond, in the event that an attempt is made to take a bottle carrying the security device out of a store. Though the device of WO 01/75254 is able to function adequately with many designs of bottle, further research and development has significantly improved that device, in order to give greater security to resist unauthorised removal and also to permit the device to be fitted to a wider range of bottles.

BRIEF SUMMARY OF THE INVENTION

According to this invention, there is provided a security device for a bottle having a neck fitted with a closure, which device comprises a body defining a sleeve into which at least a part of the bottle neck and its closure may be received and also defining a housing to one side of the sleeve. A first catch member is pivoted within the housing for movement between free and locking positions, the first catch member having an inner portion which projects into the sleeve to engage behind a shoulder of the bottle neck or the closure therefor when the catch member is in its locking position with the device fitted to a bottle thereby to resist removal of the device from the bottle. An operating member is also pivoted to the housing and is movable between open and closed positions, a spring acting between the first catch member and the operating member and being arranged to urge the catch member to its locking position when the operating member is in its closed position. A magnetically-releasable latch is arranged to hold the operating member in its closed position unless acted upon by an external magnetic field.

It will be appreciated that the security device of the present invention has an improved mechanism, which allows greater security of attachment to a bottle neck, as compared to the device of WO 01/75254, as well as easier release from a bottle. Further, the improved mechanism has greater reliability in operation, both for engaging a bottle neck and subsequently when it is to be removed by magnetic release of the mechanism.

BRIEF DESCRIPTION OF THE DRAWINGS

The drawings show a specific embodiment of a bottle security device constructed and arranged in accordance with this invention, though solely by way of example. In the drawings.

DETAILED DESCRIPTION OF THE INVENTION

Figure 1:
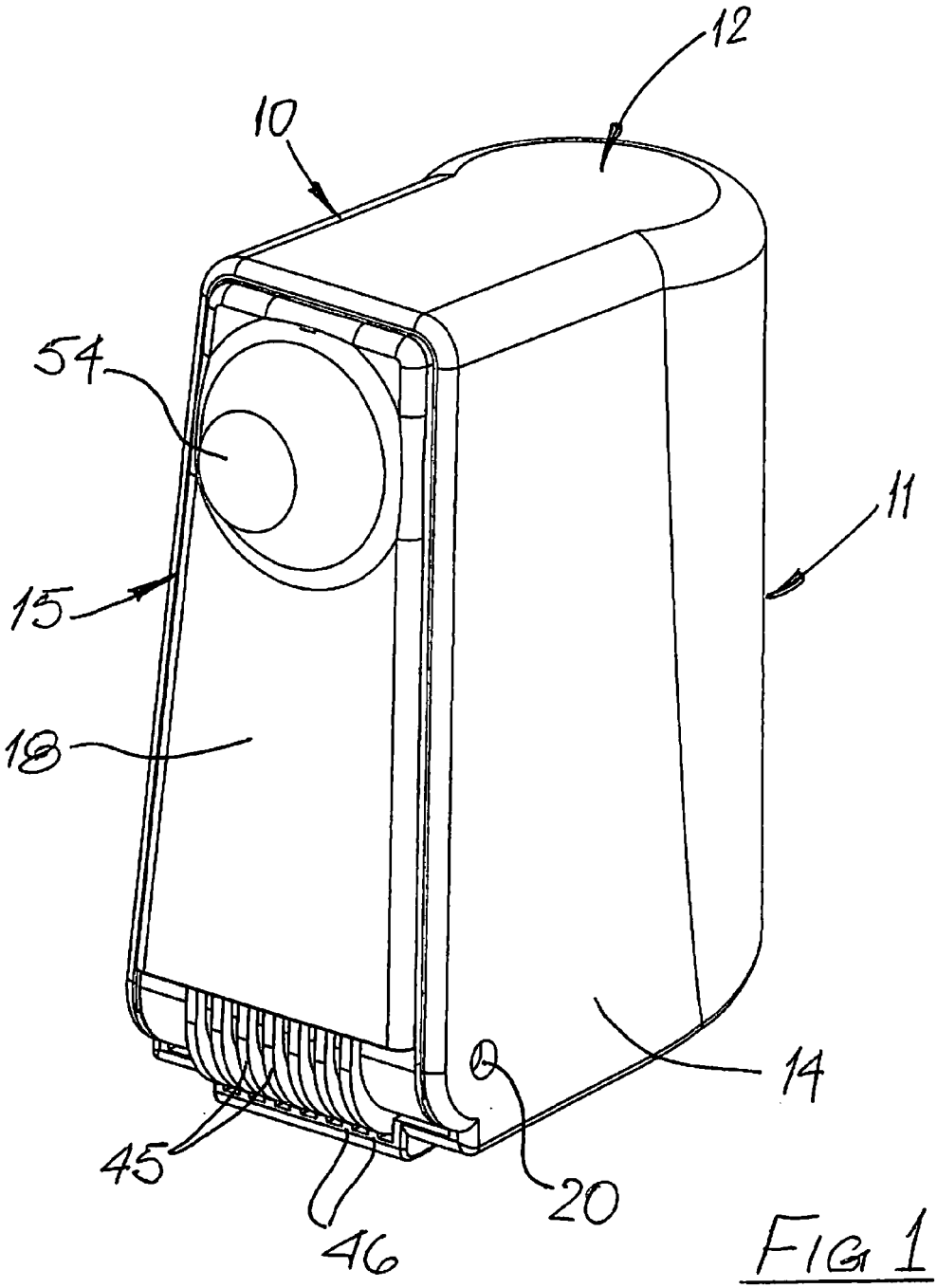
FIG. 1 is an isometric view of the embodiment of security device, with the operating member in a closed position.

In implementing the invention, security can be enhanced by providing a second catch member also pivoted to the housing for movement between free and locking positions, the second catch member being generally similar both in function and its operation to the first catch member whereby at least one of the catch members, if not both catch members, may engage behind a shoulder of the bottle neck or the closure therefor when the device is to be secured in position on a bottle neck. Advantageously, the two catch members are pivoted to the housing about a common axis but with the respective inner portions being displaced by different distances along the sleeve in the axial direction thereof. Movement of the operating member to its open position may reduce the force of the spring means acting on the first catch member, or both catch members where two are provided, and allow the catch members to move away from the sleeve. For example, such spring means may comprise a helical compression spring disposed between the respective catch member and the operating member.

The operating member itself advantageously is pivoted to the housing about said common axis. The housing may have an external opening such that when the operating member is in its closed position, that operating member closes the opening and so prevents access to the interior of the housing. For this arrangement, movement of the operating member from its closed position to its open position is performed by pivoting the operating member away from the housing and so out of the opening, relieving the spring force on the or each catch member.

The magnetically-releasable latch preferably comprises a ferromagnetic latch member pivoted to one of the operating member and the housing, a keep provided on the other of the operating member and the housing which keep is engaged by the latch member when the operating member is in its closed position. The latch member is movable under the influence of an external magnetic field, preferably against the action of a spring, to come free of the keep, thereby permitting the operating member to move to its open position.

A preferred embodiment of security device of this invention has a guard member mounted for movement across the end of the sleeve into which the bottle neck is inserted, the guard member being spring urged into engagement with an inserted bottle neck. Such a guard member may restrict access to the catch members from the open end of the sleeve, thereby to prevent unauthorised release of those members to free the device from a bottle. A ratchet mechanism may be operatively associated with the guard member, which ratchet mechanism serves to resist withdrawal of the guard member from a bottle-engaging position, when the operating member is in its closed position. However, movement of the operating member to its open position should release the ratchet mechanism to permit the guard member to move back to a position where it does not obstruct the insertion of a bottle neck into the sleeve.

In this preferred embodiment, the ratchet mechanism may include a cam provided with ratchet teeth and engageable with the guard member, a spring being arranged to drive the cam to advance the guard member across the open end of the sleeve. Such a cam may be mounted for rotation about the same common axis of pivoting of the operating member and the catch members. In this case, the spring may urge the guard member to a bottle engaging position when the operating member is in its closed position. Such a spring may comprise a helical spring disposed about the pivoting axis of the operating member and acting in torsion on the cam.

In order to enhance security and minimise the opportunity for fraudulent release of the security device when fitted to a bottle, the housing and operating member may be provided with respective interfitting ribs and grooves in the region of the pivotal connection thereof. Such ribs and grooves should define a labyrinthine path to prevent the insertion of a flexible blade into the release mechanism.

Referring now to the drawings, these show a preferred embodiment of security device which comprises a body 10 defining a sleeve 11 having a closed end 12 and an open end 13, the internal cross-section of the sleeve being generally circular and tapering from the open end 13 towards the closed end 12. The dimensions of the sleeve are such that a wide range of conventional bottles such as are used for example for alcoholic drinks may be inserted into the sleeve from the open end 13 thereof. The body 10 also defines a generally rectangular housing 14 to one side of the sleeve, the housing 14 having an opening 15 on the face of the housing generally opposed to the sleeve 11. An aperture 16 is provided through an internal wall of the body separating the housing from the sleeve 11, such that components of an operating mechanism (as will be described below) may project through that aperture into the sleeve, as best appreciated from FIG. 3.

The operating mechanism for the security device comprises an operating member 18 pivoted at one end to the housing 14 adjacent the open end 13 of the sleeve, by means of a pin 19 extending through aligned bores 20 in the housing and operating member respectively. The operating member 18 has a front wall 21 profiled to fit within the opening 15 of the housing, as shown in FIG. 1, there being side walls 22 and an end wall 23 upstanding from the front wall 21, so as to define a chamber within the operating member 18.

Figure 4:
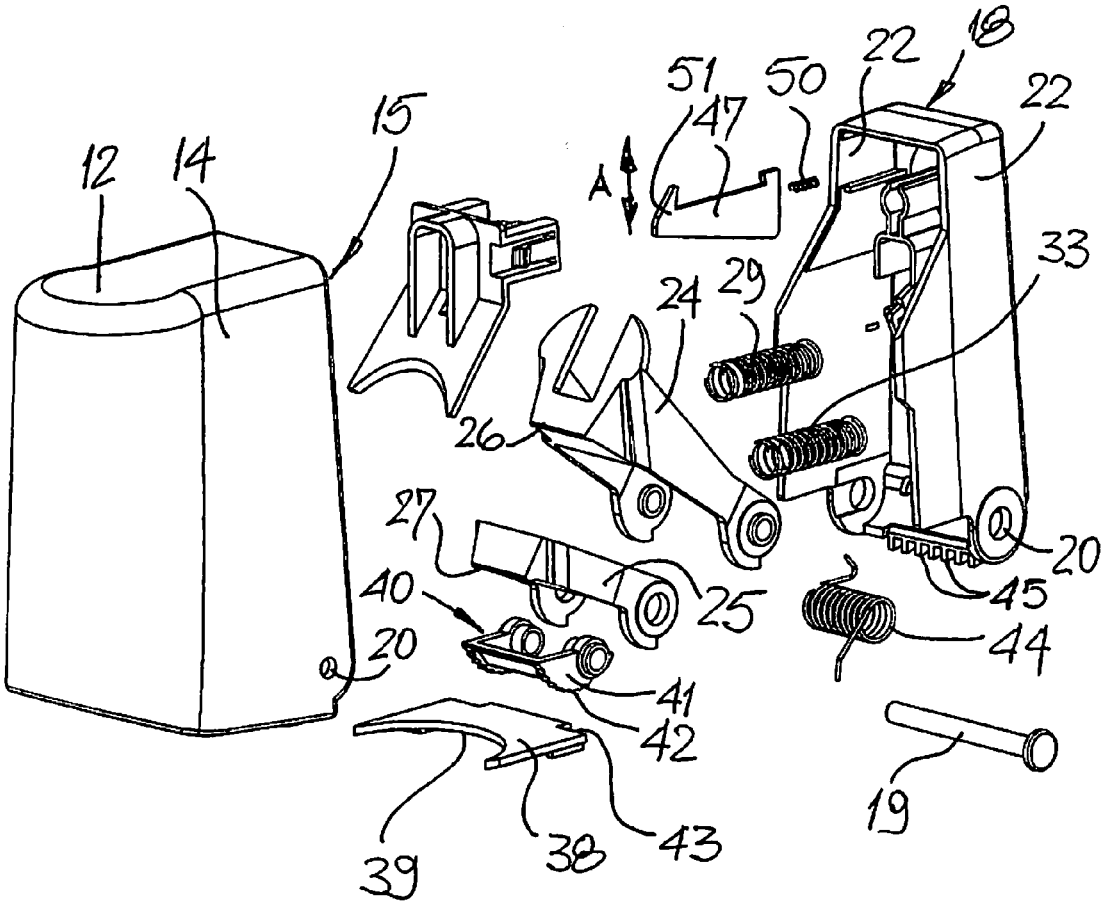
FIG. 4 is an exploded view of the device, showing the component parts.

As best seen in FIGS. 1 and 4 the curved part of the front wall 21 of the operating member 18 in the region of the pivotal connection to the housing is provided with a series of ribs 45, the housing having a corresponding series of fibs 46 arranged so that the ribs on one component fit into the grooves between the ribs of the other component. In this way, the gap between the housing and operating member in the region of the pivotal connection has a labyrinthine profile, so preventing the insertion of a flexible blade through that gap, into the housing.

Figure 3:
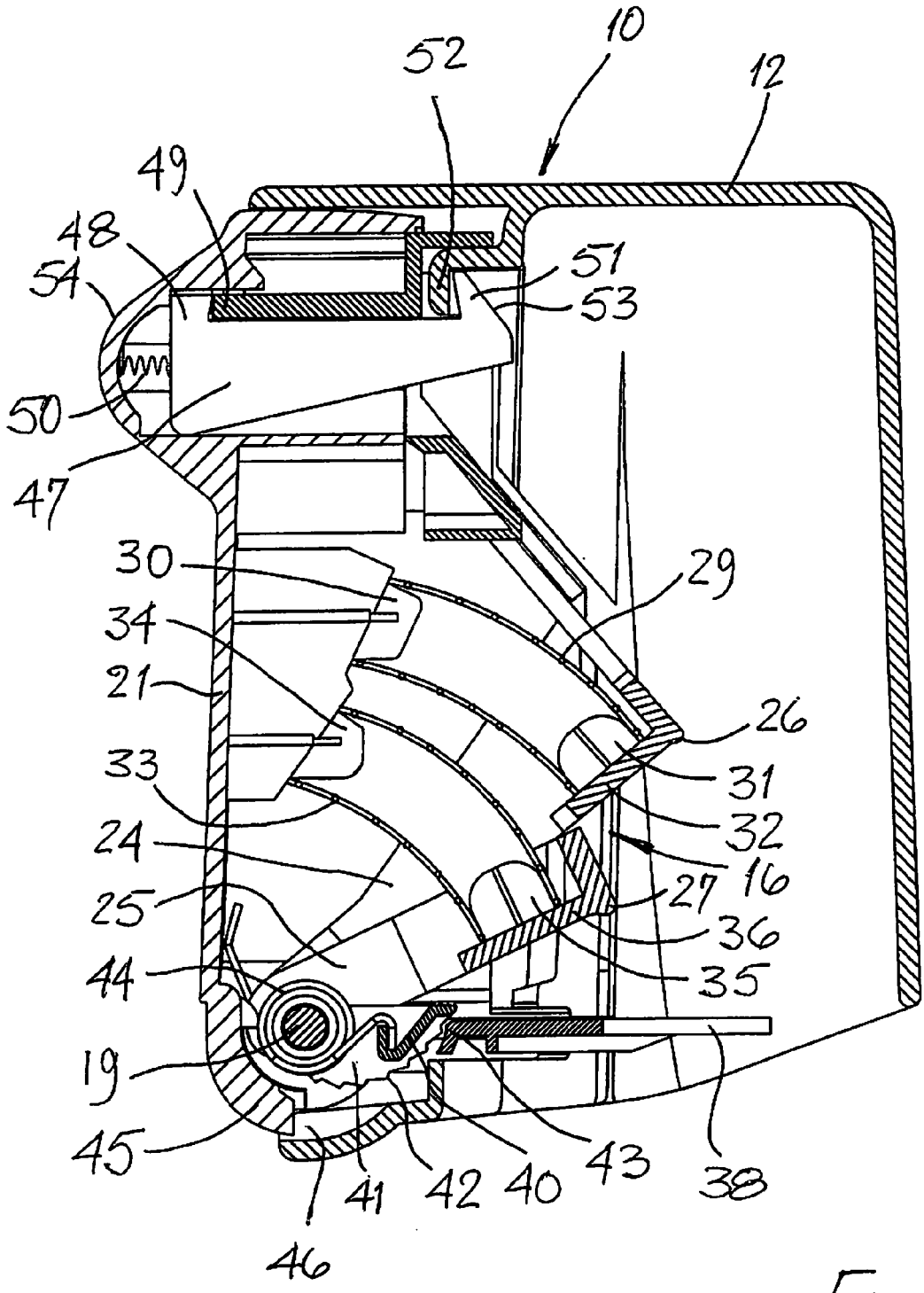
FIG. 3 is an axial cross-section through the security device when in the position shown in FIG. 1.

Also pivoted about pin 19, but between the side walls 22 of the operating member 18, are first and second catch members 24,25. Each catch member is of a generally U-shaped form, with the limbs of the first catch member being of a greater length than those of the second catch member whereby the second catch member may be disposed between and move relative to the limbs of the first catch member. The catch members have respective leading portions 26,27 at the base ends of the respective U-shaped forms, the leading portions being arranged to project through the aperture 16 into the sleeve, when the operating member 18 is in its closed position as shown in FIG. 3. Each such leading portion defines a sharp corner between two walls of the leading portion disposed at right angles, which corner may engage behind a shoulder provided on a bottle neck or its closure when that bottle neck is inserted into the sleeve.

Figure 2:
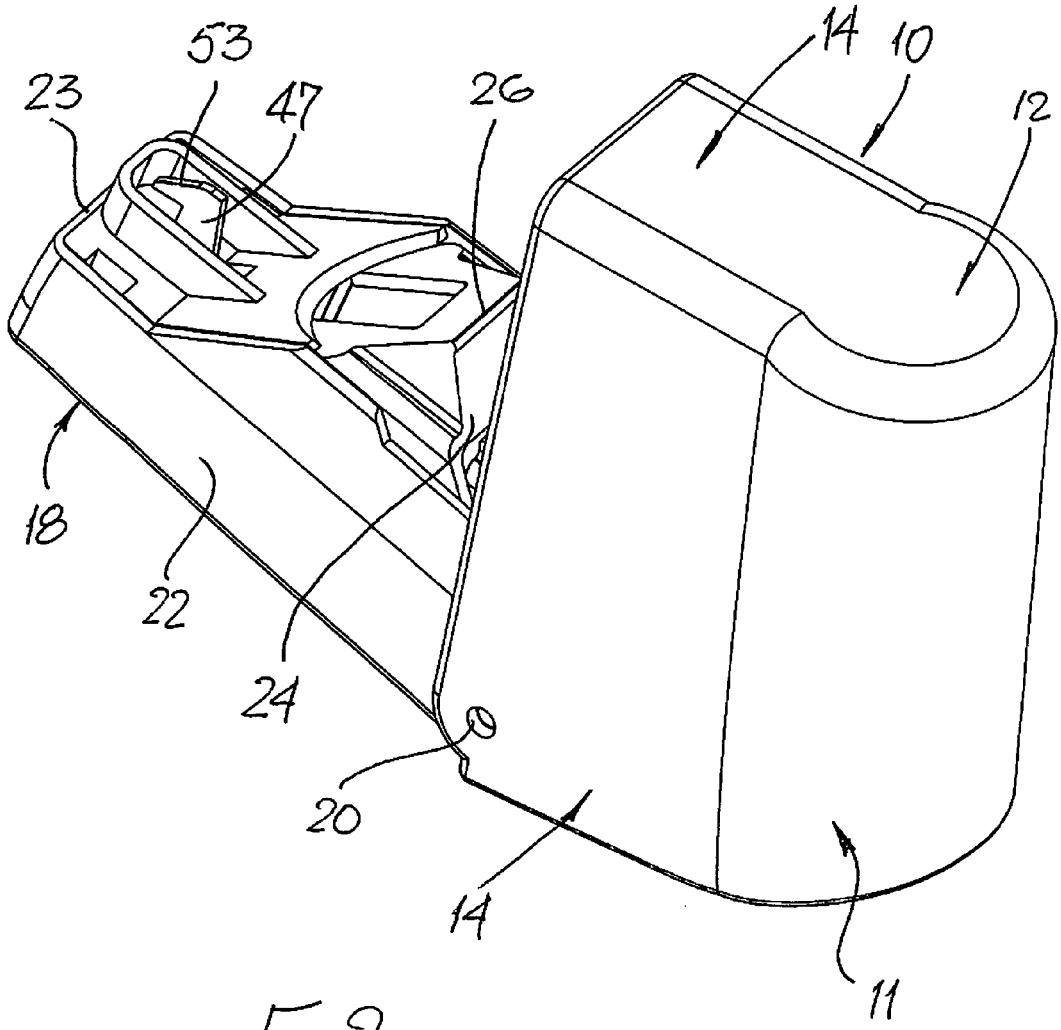
FIG. 2 is an isometric view of the security device of FIG. 1, but from a different angle and showing the operating member in an open position.

A first helical compression spring 29 is disposed between a formation 30 provided internally of the operating member 18 on the front wall 21 thereof and a nipple 31 provided on a wall 32 of the leading portion 26 of the first catch member 24, so as to urge apart the operating member and the first catch member, about the common pivotal axis defined by pin 19. In a similar way, a second helical compression spring 33 is disposed between a formation 34 on the operating member and a nipple 35 on a wall 36 of the second catch member 25. The springs 29,33 thus urge the catch members 24,25 angularly away from the operating member 18 to limiting positions defined by interactions between the arms of the catch members and the operating member. In this way, the leading portions 26,27 of the two catch members 24,25 are independently urged to project through the aperture 16 into the sleeve 11, when the operating member is moved to its closed position as shown in FIGS. 1 and 3, the springs being compressed as necessary when the leading portions engage a bottle neck within the sleeve to permit the operating member to move to its closed position. Conversely, when the operating member is moved to its open position as shown in FIG. 2, the catch members 24,25 may move to their limiting positions separated from the operating member.

Adjacent the open end 13 of the sleeve 11, the housing 14 supports a guard plate 38 slidable between a withdrawn position where the open end of the sleeve is essentially unobstructed and a forward position where the guard plate extends partially across the open end of the sleeve. As shown in FIG. 4, the guard plate has a curved forward profile 39, so as to be capable of fitting reasonably closely to the neck of a bottle inserted into the sleeve. A generally U-shaped cam member 40 is pivoted on pin 19 so as to be rotatable about the same common axis of pivoting as the operating member 18 and first and second catch members 24,25, the cam member fitting between the arms of the second catch member 25. The cam member 40 has a pair of spaced snail-cams 41 each provided with external ratchet teeth 42 which teeth are engageable with lands 43 provided on the rear edge of the guard plate 38. A helical spring 44 is carried about pin 19 and has one end extended to serve as an arm engaging the internal face of front wall 21 of the operating member, the other end of the spring being hooked around the cam member 40. The spring 44 thus acts in torsion, to apply a clockwise moment to the cam member 40, as viewed in FIG. 3, and so driving the guard plate to its forward position, across the open end of the sleeve.

A magnetically-releasable latch mechanism is provided to hold the operating member 18 in its closed position as shown in FIGS. 1 and 3. This latch mechanism comprises an elongate latch member 47 carried within the operating member adjacent the end wall 23 and mounted for limited pivoting movement in the direction of arrow A marked on FIG. 4. The latch member has a leg 48 which engages behind a shoulder 49 formed as a part of a cover plate for the chamber defined by the operating member. A spring 50 urges the latch member in a counter-clockwise direction (FIG. 3) with the latch member pivoting about the engagement point of the leg 48 with shoulder 49, such that the spring 50 lifts a forward latch part 51 of the latch member 47.

The housing 14 provides a keep 52 for the latch part 51 of the latch member 47. As shown in FIGS. 3 and 4, that latch part 51 has a ramp surface 53 which serves to deflect the latch part 51 downwardly against the action of spring 50 as the operating member is moved to its closed position until the latch part 51 may engage behind the keep 52 and so serve to maintain the operating member in its closed position. Application of a suitable external magnetic field to a protrusion 54 formed in the front wall 21 of the operating member attracts the rear part of the latch member against the action of the spring 50, so moving the latch part 51 away from the keep 52 and then permitting movement of the operating member 18 away from its closed position (FIGS. 1 and 3) towards its open position (FIG. 2).

Though not shown in the drawings, a security label may be adhesively secured to any suitable part of the device, for operation by a store security system. For example, an r.f. inductance coil-type label may be stuck to a surface of the body or the outer face of the operating member 18.

In use, the operating member of the security device is set to its open position (FIG. 2), if necessary by using a magnet to release the latch member 47 from the keep 52. In this open position, the first and second catch members are clear of the sleeve 11 and the guard plate 38 is free to slide to its withdrawn position. The security device is then fitted to a bottle neck and the operating member 18 is moved to its closed position (FIGS. 1 and 3), the latch part 51 of the latch member 47 engaging behind the keep 52 to maintain the operating member in its closed position. The catch members 24,25 engage the bottle neck before the operating member is moved to its closed position, whereafter the catch members remain stationary relative to the bottle neck while the operating member may continue its movement, compressing the springs 29,33. In turn, this increases the force with which the catch members engage the bottle neck, in order to resist those catch members moving over a shoulder on the bottle neck or a closure fitted thereto.

Further, the snail-cams 41 of the cam member 40 engage the lands 43 of the guard plate 38, initially with the snail-cams in a counter-clockwise position with respect to the lands 43. Movement of the operating member 18 to its closed position applies an increasing rotational force to those snail-cams so urging the guard plate 38 across the open end of the sleeve until the forward profile 49 of the guard plate engages the neck of a bottle. Once engaged, moving the operating member 18 to its closed position increases the force on the guard plate but the ratchet teeth mechanically prevent withdrawal of the guard plate. In this way, the guard plate prevents access up the sleeve from the open end to the leading portions 26,27 of the catch members 24,25, thereby preventing unauthorised movement of those catch members to free the security device from a bottle neck. In addition, the labyrinthine gap between the operating member 18 and the housing 14 in the region of the pivotal connection thereof prevents the insertion of a flexible blade into the housing, to frustrate an attempt at releasing the catch members with such a blade.

When the security device is to be removed from a bottle, a suitable magnetic force is applied to the protrusion 54 of the operating member, so freeing the latch part 51 from the keep 52. This allows the operating member 18 to move to its open position, so withdrawing the leading portions 26,27 of the catch members 24,25 from the aperture 16 and permitting the guard plate 38 to slide to its withdrawn position. Thereafter, the security device may simply be lifted off a bottle and is ready for re-use on another.

I claim:

1. A security device for a bottle having a neck fitted with a closure, said device comprising:

a body defining a sleeve into which at least a part of the bottle neck and its closure can be inserted, the body also defining a housing to one side of said sleeve;

a first catch member pivoted within the housing for movement between free and locking positions, the first catch member having an inner portion which projects into the sleeve to engage behind a shoulder of the bottle neck or the closure therefor when the catch member is in its locking position with the device fitted to a bottle thereby to resist removal of the device from the bottle;

an operating member also pivoted to the housing and movable between open and closed positions;

spring means acting between the first catch member and the operating member and arranged to urge the catch member to its locking position when the operating member is in its closed position; and a magnetically-releasable latch arranged to hold the operating member in its closed position unless acted upon by an external magnetic field.

2. A security device as claimed in claim 1, wherein movement of the operating member to its open position reduces the force of the spring means acting on the first catch member thereby to permit the first catch member to move towards its free position.

3. A security device as claimed in claim 2, wherein the spring means comprises a helical compression spring disposed between the first catch member and the operating member.

4. A security device as claimed in claim 1, wherein there is provided a second catch member also pivoted to the housing for movement between free and locking positions, the second catch member having an inner portion which projects into the sleeve such that the inner portion of at least one of the first and second catch members may engage behind a shoulder of the bottle neck or the closure therefor when the catch members are in their respective locking positions with the device fitted to a bottle thereby to resist removal of the device from the bottle, there being spring means acting between the second catch member and the operating member and arranged to urge the second catch member to its locking position when the operating member is in its closed position.

5. A security device as claimed in claim 4, wherein movement of the operating member to its open position reduces the force of the spring means acting on the second catch member thereby to permit the second catch member to move towards its free position.

6. A security device as claimed in claim 5, wherein the spring means comprises a helical compression spring disposed between the second catch member and the operating member.

7. A security device as claimed in claim 4, wherein the first and second catch members are pivoted to the housing about a common axis.

8. A security device as claimed in claims 7, wherein the operating member is pivoted to the housing about said common axis.

9. A security device as claimed in claim 1, wherein the housing has an external opening and when in its closed position the operating member closes said opening.

10. A security device as claimed in claim 9, wherein the operating member is pivoted to the housing for movement away from the housing to open said opening when the operating member is moved to its open position.

11. A security device as claimed in claim 10, wherein the operating member is pivoted to the housing for movement away from the housing to open said opening when the operating member is moved to its open position.

12. A security device as claimed in claim 1, wherein said magnetically-releasable latch comprises a ferromagnetic latch member pivoted to one of the operating member and the housing and a keep provided on the other of the operating member and the housing, the keep being engageable by the latch member when the operating member is in its closed position but being movable to be free of the keep by an external magnetic field.

13. A security device as claimed in claim 12, wherein the latch member is spring-urged to its keep-engaging position, and is movable away therefrom by the applied external magnetic field.

14. A security device as claimed in claim 11, wherein the latch member is mounted on the housing and the keep is provided on the operating member.

15. A security device as claimed in claim 1, wherein the sleeve has an open end into which the bottle neck is inserted, and there is a guard member mounted for movement across said open end of the sleeve, said guard member being spring-urged to engage an inserted bottle neck.

16. A security device as claimed in claim 15, wherein a ratchet mechanism is operatively associated with the guard member, which ratchet mechanism resists withdrawal of the guard member from a bottle-engaging position when the operating member is in its closed position.

17. A security device as claimed in claim 16, wherein the ratchet mechanism includes a cam provided with ratchet teeth and engageable with the guard member, and a spring driving the cam to advance the guard member across said one end of the sleeve.

18. A security device as claimed in claim 17, wherein the cam is pivoted to the housing about the same axis as the first catch member is pivoted to the housing.

19. A security device as claimed in claim 18, wherein the cam driving spring is a helical spring disposed between the cam and the operating member and acting in torsion.

* * * * *

UNITED STATES PATENT AND TRADEMARK OFFICE

CERTIFICATE OF CORRECTION

PATENT NO. : 7,372,363 B2
APPLICATION NO. : 11/031050
DATED : May 13, 2008
INVENTOR(S) : Paul Francis Durbin It is certified that error appears in the above-identified patent and that said Letters Patent is hereby corrected as shown below:

Title page, item (74), delete "Shupe & Munger Ltd." and insert --Jansson Shupe & Munger Ltd.--.

In column 4, line 17 delete "fibs" and insert --ribs--.

Signed and Sealed this

Second Day of September, 2008

JON W. DUDAS
*Director of the United States Patent and Trademark Office*